US009689199B1

(12) United States Patent
Chen

(10) Patent No.: US 9,689,199 B1
(45) Date of Patent: Jun. 27, 2017

(54) LIFT-CORD GUIDE FOR WINDOW BLIND

(71) Applicant: Chin-Fu Chen, Taichung (TW)

(72) Inventor: Po-Yu Chen, Taichung (TW)

(73) Assignee: CHIN-FU CHEN, Taichung (TW)

( * ) Notice: Subject to any disclaimer, the term of this patent is extended or adjusted under 35 U.S.C. 154(b) by 0 days.

(21) Appl. No.: 15/087,368

(22) Filed: Mar. 31, 2016

(30) Foreign Application Priority Data

Dec. 21, 2015 (TW) ..... 104142945 A

(51) Int. Cl.
*E06B 9/324* (2006.01)
*E06B 9/327* (2006.01)
*E06B 9/322* (2006.01)
*E06B 9/323* (2006.01)

(52) U.S. Cl.
CPC ..... *E06B 9/327* (2013.01); *E06B 9/322* (2013.01); *E06B 9/323* (2013.01)

(58) Field of Classification Search
CPC ..... E06B 9/322; E06B 9/323; E06B 9/327; E06B 2009/3222
See application file for complete search history.

(56) References Cited

U.S. PATENT DOCUMENTS 4,180,118 A * 12/1979 Vecchiarelli ..... E06B 9/324 160/178.2
4,667,723 A * 5/1987 Spangenberg ..... E06B 9/324 160/178.2
5,472,035 A * 12/1995 Biba ..... E06B 9/306 160/168.1 R
6,516,860 B1 * 2/2003 Weaver ..... E06B 9/30 160/168.1 R
7,343,957 B2 * 3/2008 Lin ..... E06B 9/262 160/168.1 R
8,925,615 B2 * 1/2015 Lin ..... E06B 9/322 160/170
2007/0056692 A1 * 3/2007 Nien ..... E06B 9/322 160/168.1 R

* cited by examiner

*Primary Examiner* — Katherine Mitchell
*Assistant Examiner* — Abe Massad
(74) *Attorney, Agent, or Firm* — Muncy, Geissler, Olds & Lowe PC

(57) ABSTRACT

A lift-cord guide for window blind is disclosed to include a roller holder including a pull cord inlet and a pull cord outlet extending in a perpendicular manner relative to the pull cord inlet, and a first guide roller rotatably mounted in the roller holder at the intersection between the extending direction of the pull cord inlet and the extending direction of the pull cord outlet. The axial direction of the first guide roller obliquely intersects with the extending direction of the pull cord inlet, and defines with the extending direction of the pull cord outlet a contained angle smaller than 90-degrees. Thus, the lift-cord guide of the invention effectively reduces the turning angle of the pull cords, and smoothens the operation to open or close the blind slats.

4 Claims, 3 Drawing Sheets

LIFT-CORD GUIDE FOR WINDOW BLIND

BACKGROUND OF THE INVENTION

1. Field of the Invention

The present invention relates to window blind technology, and more particularly to a lift-cord guide for window blind.

2. Description of the Related Art

In a window blind, the lifting of the blind slats is controlled by a cord retractor by means of pull cords. The pull cords are extended horizontally from the cord retractor and then guided downwardly to the blind slats by one or multiple guide rollers. Thus, the pull cords must be extended over the guide rollers to change the extending direction for lifting the blind slats.

According to the prior art design, the guide rollers are disposed in horizontal. Thus, the pull cords are guided by the guide rollers to change the extending direction toward the blind slats through a large turning angle. This large turning angle increases the friction resistance, affecting the smoothness during the operation to open or close blind slats.

SUMMARY OF THE INVENTION

The present invention has been accomplished under the circumstances in view. It is the main object of the present invention to provide a lift-cord guide used in a window blind, which effectively reduces resistance, thereby smoothing the operation to lift the blind slats.

To achieve this and other objects of the present invention, a lift-cord guide comprises a roller holder and a first guide roller. The roller holder comprises a pull cord inlet and a pull cord outlet. The extending direction of the pull cord inlet is perpendicular to the extending direction of the pull cord outlet. The first guide roller is rotatably mounted in the roller holder at the intersection between the extending direction of the pull cord inlet and the extending direction of the pull cord outlet. Further, the axial direction of the first guide roller obliquely intersects with the extending direction of the pull cord inlet, and defines with the extending direction of the pull cord outlet a contained angle smaller than 90-degrees.

Thus, the lift-cord guide of the invention effectively reduces the turning angle of the pull cords and the resistance suffered by the pull cords, and smoothens the operation to open or close the blind slats.

Preferably, the first guide roller defines a first tangential direction, and a second tangential direction perpendicular to the first tangential direction. Further, the first tangential direction goes through the pull cord inlet of the roller holder. Further, the second tangential direction goes through the pull cord outlet of the roller holder. Thus, the pull cord is extended through the pull cord inlet and wound round the first guide roller along the first tangential direction of the first guide roller, and then extended along the second tangential direction of the first guide roller to the pull cord outlet toward the outside, and thus, this design enhances the moving stability and smoothness of the pull cord.

Preferably, the lift-cord guide further comprises a second guide roller rotatably mounted in the roller holder within the pull cord outlet. Further, the axial direction of the second guide roller is parallel to the extending direction of the pull cord inlet and perpendicular to the extending direction of the pull cord outlet to enhance the moving smoothness of the pull cord in the pull cord outlet.

Other advantages and features of the present invention will be fully understood by reference to the following specification in conjunction with the accompanying drawings, in which like reference signs denote like components of structure.

DETAILED DESCRIPTION OF THE INVENTION

Figure 1:
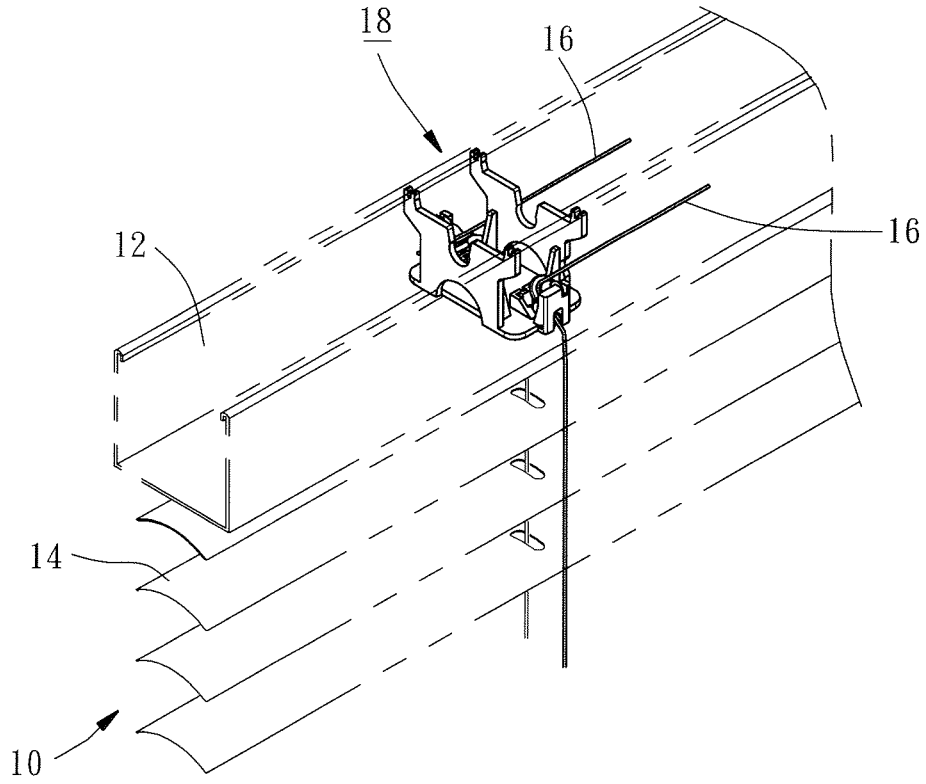
FIG. 1 is a schematic drawing illustrating a lift-cord guide mounted in a window blind in accordance with the present invention.

Referring to FIG. 1, a window blind 10 comprises a headrail 12, a set of blind slats 14 arranged below the headrail 12, two pairs of pull cords 16 (only one pair shown in FIG. 1) extending from the headrail 12 to the blind slats 14, and two lift-cord guides 18 (only one lift-cord guide shown in FIG. 1) respectively mounted in the headrail 12 near two opposite ends thereof for guiding one respective pair of pull cords 16. The two lift-cord guides 18 are identical, and thus, one lift-cord guide 18 is described hereinafter.

Figure 2:
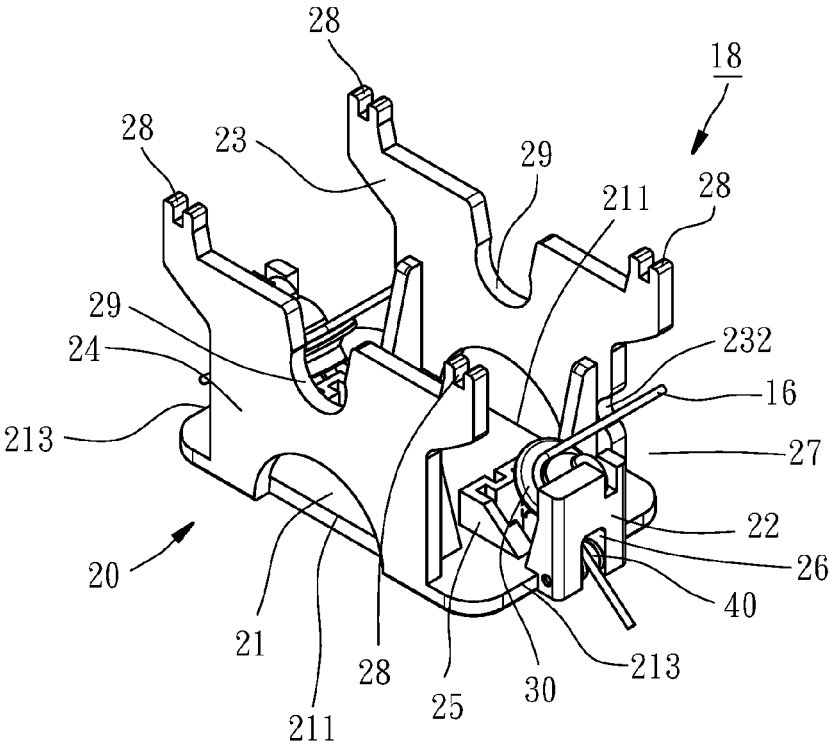
FIG. 2 is an oblique top elevational view of the lift-cord guide in accordance with the present invention.
Figure 3:
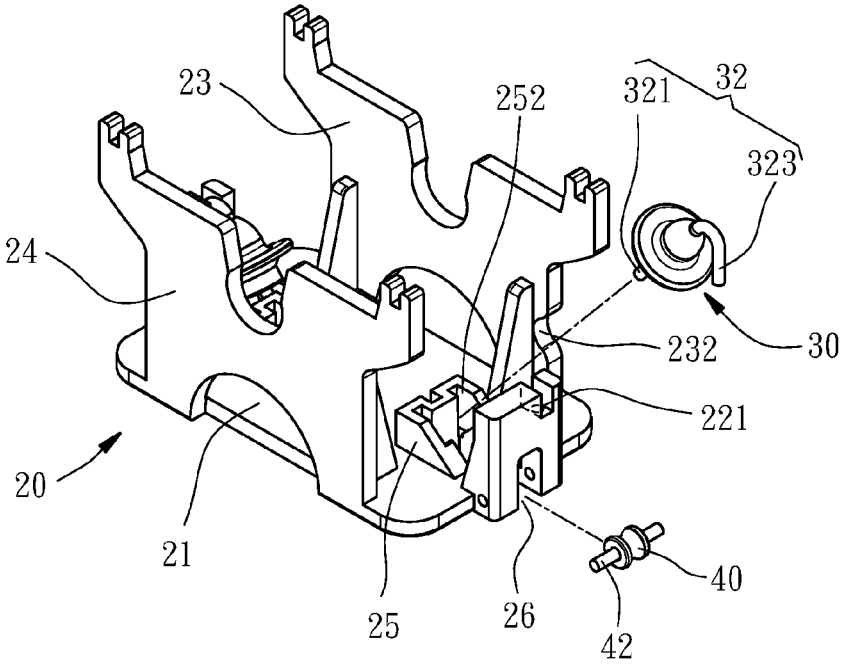
FIG. 3 is an exploded view of the lift-cord guide in accordance with the present invention.

As illustrated in FIGS. 2 and 3, the lift-cord guide 18 comprises a roller holder 20, two first guide rollers 30, and two second first guide rollers 40.

The roller holder 20 comprises a rectangular bottom wall 21, two opposing end walls 22, an inner sidewall 23, an opposing outer sidewall 24, and two bearing seats 25 upwardly raised from a top surface of the rectangular bottom wall 21 and respectively disposed adjacent to the end walls 22. Each bearing seat 25 defines therein a locating groove 252. Each end wall 22 comprises a plug hole 221 located at a top side thereof corresponding to the locating groove 252 at one respective bearing seat 25, and a pull cord outlet 26 located at a bottom side thereof and abutted to one of the short sides 213 of the rectangular bottom wall 21. The inner sidewall 23 and the outer sidewall 24 have the respective bottom sides thereof respectively connected to the two opposite long sides 211 of the rectangular bottom wall 21 so that two pull cord inlets 27 are defined between two opposite lateral sides of the inner sidewall 23 and the two end walls 22. The extending direction of the pull cord inlets 27 is perpendicular to the extending direction of the pull cord outlets 26. Further, two notches 232 are respectively located at the two opposite lateral sides of the inner sidewall 23 to face toward the respective pull cord inlets 27, preventing interference between the pull cords 16 and the inner sidewall 23 during operation. The inner sidewall 23 and the outer sidewall 24 each further comprise two retaining portions 28 bilaterally located at a top side thereof, and a mounting recess 29 defined between the two retaining portions 28. By means of the retaining portions 28, the inner sidewall 23 and the outer sidewall 24 are fastened to the headrail 12 to secure the roller holder 20 to the inside of the headrail 12. The mounting recess 29 is adapted for receiving a blind slat tilting adjustment device (not shown) to hold it in the roller holder 20.

Figure 4:
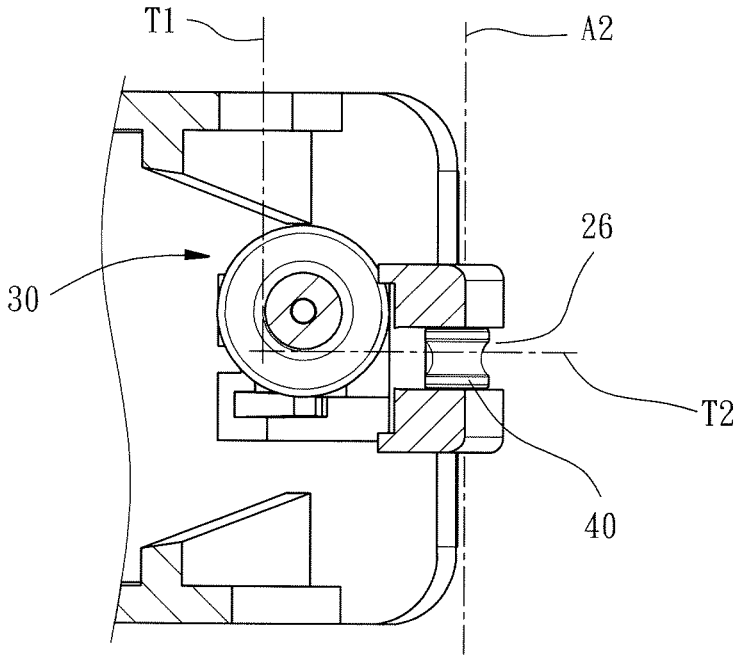
FIG. 4 is a sectional view of a part of the present invention illustrating the positioning relationship between the first guide roller, the pull cord inlet and the pull cord outlet.
Figure 5:
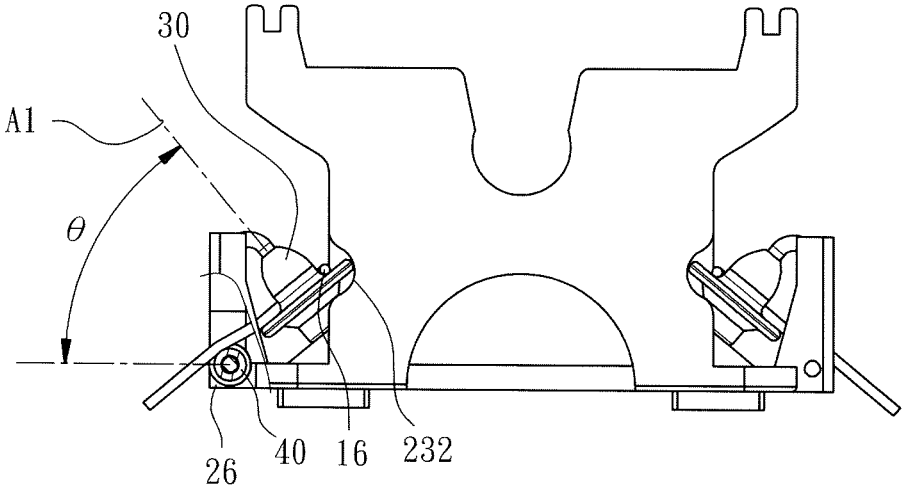
FIG. 5 is a schematic sectional side view of a part of the present invention illustrating the positioning relationship between the first guide roller and the pull cord outlet.

The first guide rollers 30 are respectively disposed in the intersections between the extending direction between of the pull cord inlets 27 and the extending direction of the pull cord outlets 26. Further, as illustrated in FIG. 5, the axial direction A1 of the first guide rollers 30 obliquely intersects with the extending direction of the respective pull cord inlets 27, and defines with the extending direction of the respective pull cord outlets 26 a contained angle θ smaller than 90°, and thus, the first guide rollers 30 tilt toward the respective pull cord outlets 26. The first guide rollers 30 are respectively pivotally mounted the roller holder 20 with a respective first wheel axle 32. The first wheel axle 32 has a linear section 321 and a bending section 323 connected to one end of the linear section 321. The first wheel axle 32 has a top end thereof plugged in the plug hole 221 at one respective end wall 22 of the roller holder 20, and an opposing bottom end thereof plugged in the locating groove 252 at one respective bearing seat 25 of the roller holder 20. Further, as illustrated in FIG. 4, each first guide roller 30 defines a first tangential direction T1, and a second tangential direction T2 perpendicular to the first tangential direction T1. The first tangential direction T1 goes through the respective pull cord inlet 27. The second tangential direction T2 goes through the respective pull cord outlet 26.

The second guide rollers 40 are respectively mounted in the pull cord outlets 26 of the roller holder 20 with a respective second wheel axle 42, and adapted for guiding the respective pull cords 16 downwardly toward the blind slats 14. The axial direction A2 of the second guide rollers 40 is parallel to the extending direction of the pull cord inlets 27 and perpendicular to the extending direction of the pull cord outlets 26.

Thus, subject to the tilted arrangement of the first guide rollers 30, the positioning relationship between the first tangential direction T1 of the first guide rollers 30 and the pull cord inlets 27 of the roller holder 20, and the positioning relationship between the second tangential direction T2 of the first guide rollers 30 and the pull cord outlets 26 of the roller holder 20, the pull cords 16 are wound round the respective first guide rollers 30 along the first tangential direction T1 of the first guide rollers 30, after entered the respective pull cord inlets 27, and then wound round the respective second guide rollers 40 along the second tangential direction T2 of the first guide rollers 30, and finally guided by the respective second guide rollers 40 toward the outside of the respective pull cord outlets 26, thereby effectively reducing the turning angle of the pull cords 16 and the resistance suffered by the pull cords 16 and smoothening the operation to open or close the blind slats 14.

What is claimed is:

1. A lift-cord guide used in a window blind comprising a pull cord, the lift-cord guide comprising:

a roller holder comprising a bottom wall having a rectangular shape, two bearing seats, and a pair of long sides and a pair of short sides, a first sidewall and a second sidewall arranged on the pair of long sides respectively, two end walls arranged on the pair of short sides respectively, the end walls being separated from the first sidewall in such a way that two pull cord inlets are respectively defined between the end walls and the first sidewall, each of the end walls having a top, a bottom, a plug hole located at the top and a pull cord outlet located at the bottom, the bearing seats being located on the bottom wall and adjacent to the end walls respectively, each of the bearing seats having a locating groove and two first guide rollers each having a first wheel axle, each of the first wheel axles having a linear section and a bending section connected to one end of the linear section, each of the two linear sections of the two first guide rollers being rotatably and obliquely mounted in the locating grooves, each of the bending sections being plugged in the plug holes respectively, each of the linear sections and the bottom wall defining respective angles smaller than 90 degrees.

2. The lift-cord guide as claimed in claim 1, further comprising two second guide rollers each rotatably mounted in said roller holder within said pull cord outlet.

3. The lift-cord guide as claimed in claim 1, wherein the first sidewall defines two notches open to said pull cord inlets, respectively.

4. The lift-cord guide as claimed in claim 1, wherein said first sidewall and said second sidewall of said roller holder each defines a mounting recess at a top side thereof.

* * * * *